United States Patent [19]

Sullivan et al.

[11] 4,148,142

[45] Apr. 10, 1979

[54] CARPET CUTTER

[76] Inventors: Dennis J. Sullivan; Carrie A. Sullivan, both of 305 S. Idaho Ave., Grangeville, Id. 83530

[21] Appl. No.: 845,951

[22] Filed: Oct. 27, 1977

[51] Int. Cl.[2] ..... B26B 29/00

[52] U.S. Cl. ..... 30/293; 30/294

[58] Field of Search ..... 30/294, 293, 289, 286, 30/287, 288

[56] References Cited

U.S. PATENT DOCUMENTS

| | | | |
|---|---|---|---|
| 460,993 | 10/1891 | Richardson | 30/289 |
| 3,137,070 | 6/1964 | Geier et al. | 30/289 |
| 3,514,855 | 6/1970 | Klekamp | 30/293 |
| 3,837,078 | 9/1974 | Weppner | 30/293 |
| 4,048,719 | 9/1977 | Thompson | 30/294 |

FOREIGN PATENT DOCUMENTS

| | | | |
|---|---|---|---|
| 126347 | 10/1949 | Sweden | 30/293 |

*Primary Examiner*—James L. Jones, Jr.
*Assistant Examiner*—J. T. Zatarga
*Attorney, Agent, or Firm*—Clarence A. O'Brien; Harvey B. Jacobson

[57] ABSTRACT

A carpet cutting tool having a body member formed by a pair of spaced, opposed leg portions connected together along an edge of each of the leg portions by a web arranged so that a sheet receiving slot is formed between the leg portions. Mounted on one of the leg portions of the body member for movement perpendicular to the web thereof is a handle assembly which supports a cutter assembly arranged so as to extend through an opening provided in the one of the leg portions and engage carpeting or other sheet material disposed between the leg portions. by pulling the tool relative to the material being cut, a strip of the material can be obtained for use as a baseboard covering, and the like.

5 Claims, 7 Drawing Figures

CARPET CUTTER

BACKGROUND OF THE INVENTION

1. Field of the Invention

This invention relates generally to cutting tools for sheet material, and particularly to a tool for trimming a strip from a piece of carpeting, and the like, which strip can subsequently be used as a baseboard covering.

2. Description of the Prior Art

A recent trend in the furbishing of homes, offices, and the like, is to extend wall-to-wall carpeting upwardly along the baseboard of a room. A strip of the carpeting being laid on the flooring is generally trimmed from an edge of the carpeting in order to be placed along the baseboard. For this purpose, it is necessary to cut a very accurate strip through carpeting which is sometimes rather thick and difficult to work with.

U.S. Pat. No. 3,837,078, issued Sept. 24, 1974, to A. Weppner, discloses a wallpaper trimmer which includes a wallpaper receiving slot formed by a body member which has mounted thereon a blade holder device disposed relative to the slot such that the blade will trim the edge of wallpaper received in the slot in order to remove the untrimmed edge of an end of a roll of wallpaper as is conventionally manufactured.

U.S. Pat. No. 2,607,115, issued Aug. 19, 1952, to E. Iovinelli, discloses a carpet cutting tool used for trimming the edge of carpeting to fit the flooring being covered, and which mounts a conventional utility knife, and the like, on a bracket which itself retains the edge of the carpet while same is being cut. Other examples of carpet cutting tools can be found in U.S. Pat. Nos. 3,009,247, issued Nov. 21, 1961, to H. C. Mueller, and U.S. Pat. No. 3,363,314, issued Jan. 16, 1968, to G. A. O'Brien.

U.S. Pat. No. 3,831,279, issued Aug. 27, 1974, to B. N. Burns, discloses a strap cutter for leather and similar materials, while U.S. Pat. No. 3,875,664, issued Apr. 8, 1975, to K. Diner, discloses a scribing tool adaptable for riding along a tiled wall in order to cut tile to necessary size.

SUMMARY OF THE INVENTION

It is an object of the present invention to provide a cutting tool suitable for trimming a strip of baseboard covering from the edge portion of a piece of carpeting, and the like.

It is another object of the present invention to provide a trimming tool for sheet material which is of more rigid construction than similar known trimming tools.

It is yet another object of the present invention to provide a cutting tool for sheet material wherein the width of a strip trimmed from the sheet material can be readily varied, and which is capable of cutting through material of relatively extreme thickness and toughness.

These and other objects are achieved according to the present invention by providing a cutting tool having: a body member provided with a pair of spaced, opposed leg portions and a web connecting together the leg portions, the leg portions defining therebetween a sheet receiving slot, with one of the leg portions being provided with an opening; a handle assembly mounted on one of the leg portions of the body member for movement substantially perpendicularly to the web of the body member, which web extends along corresponding edges of the leg portions; and a cutter assembly mounted on the handle assembly and arranged for being received in the opening provided in the one of the leg portions and engaging with a sheet disposed in the slot formed between the leg portions for trimming a strip of material from an edge of the sheet.

The handle assembly preferably includes a handle and a mounting arrangement for adjustably attaching the handle to the one of the leg portions of the body member. The mounting arrangement advantageously includes a through hole provided in the handle and a longitudinally extending element, or rod, slidably received in the hole provided in the handle and disposed extending longitudinally perpendicularly to the web of the body member. Suitable bearings are provided on the one of the legs of the body member for rotatably supporting the longitudinally extending element thereon in such a manner that the element can rotate relative to the bearings and permit the handle to swing relative to the body member. A threaded bore is provided in the handle so as to communicate with the hole provided through the handle, with a set screw being threadebly engaged in the bore for releasably engaging with the element and retaining the handle in a desired position relative to the longitudinal extent of the element. By this arrangement, the handle can be retained in any desired position along the length of the element in order to vary the width of the strip of material being trimmed from a sheet disposed in the slot of the body member.

The cutter assembly preferably includes a holder assembly mounted on the handle of the handle assembly and arranged extending through the opening provided in the one of the leg portions for positioning a blade supported by the holder assembly in such a position as to cut the sheet material disposed in the slot of the body member. The holder assembly advantageously comprises a blade cover provided with an elongated slot in a pair of oppositely directed, coplanar flanges extending along respective sides of the slot and toward one another for forming a pair of slide guides which slidably receive the cutting blade. A suitable clamp arrangement engages the blade and cover and retains the blade in proper position relative to the cover, and holds the cover on the handle of the tool.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
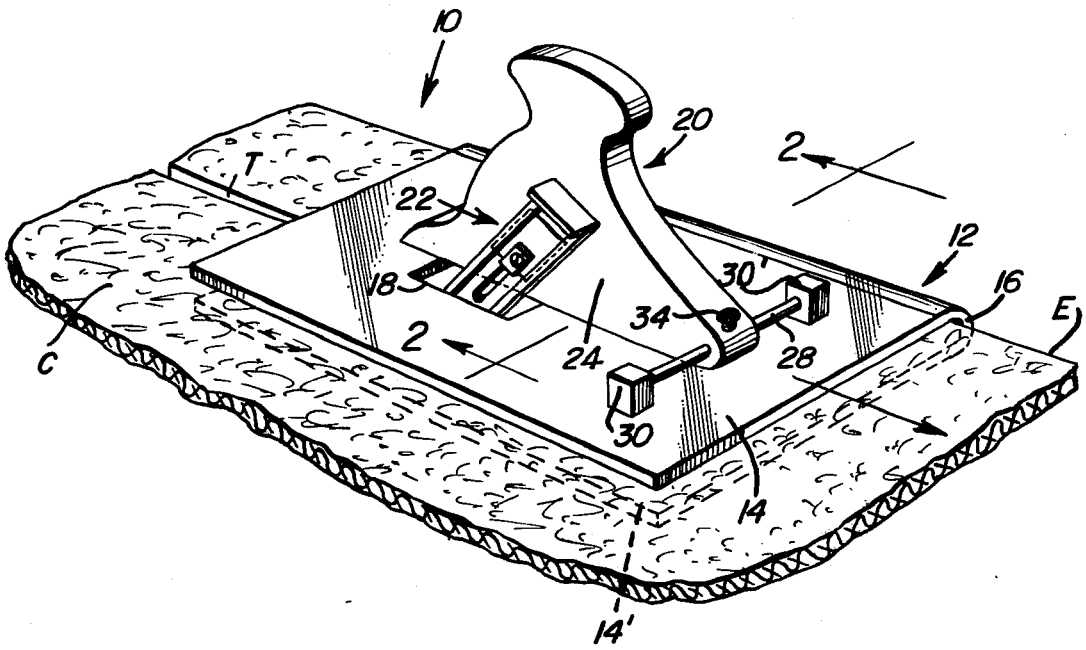
FIG. 1 is a fragmentary, perspective view showing a cutting tool according to the present invention cutting a strip from a piece of carpeting or similar material.
Figure 2:
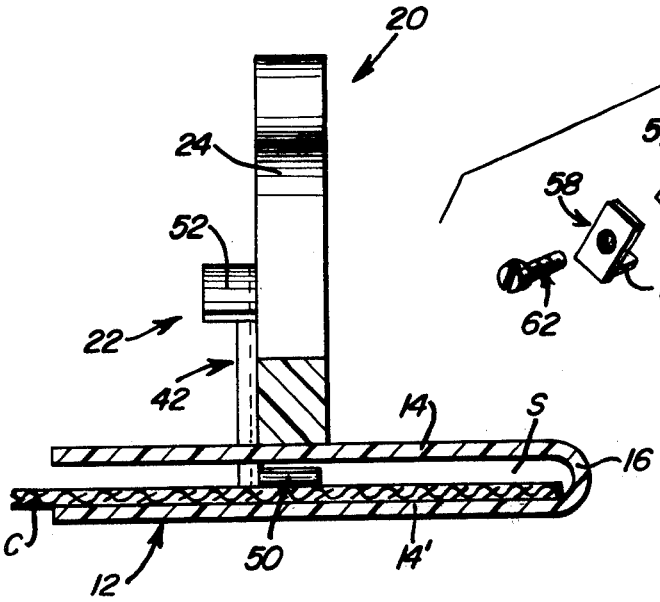
FIG. 2 is an enlarged, fragmentary, sectional view taken generally along the line 2—2 of FIG. 1.
Figure 7:
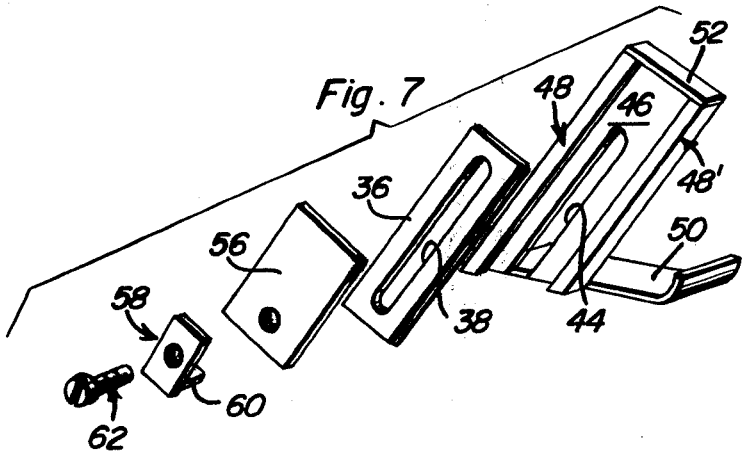
FIG. 7 is an exploded, perspective view showing a blade holder for use with a cutting tool according to the present invention.
Figure 3:
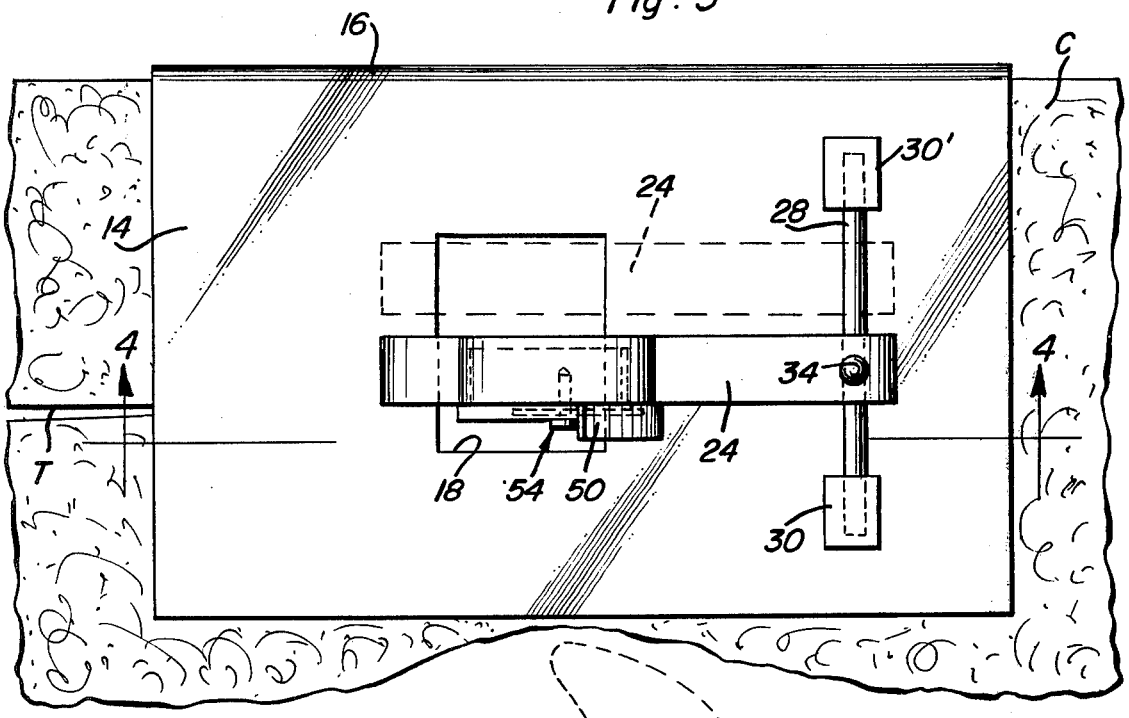
FIG. 3 is an enlarged, fragmentary, top plan view showing the arrangement seen in FIG. 1.

Referring now more particularly to the figures of the drawings, a carpet cutting tool 10 according to the present invention includes a body member 12 having a pair of spaced, opposed leg portions 14 and 14' which are substantially planar and coextensive with one another and which are connected together along corresponding edges by a web 16. Opposed openings 18 and 18' are provided in leg portions 14 and 14', respectively, for receiving a cutter assembly adjustably mounted on a handle assembly 20 and generally designated by the reference numeral 22. Handle assembly 20 is mounted on leg portion 14 of body member 12 for movement substantially perpendicularly to the extent between the legs 14, 14' of web 16 of body member 12, while the cutter assembly 22 is mounted on handle assembly 20 in such a manner as to be received in opening 18 and extend into the slot S formed between the spaced leg portions 14 and 14' and engage with a carpet C, and the like, in order to cut along carpet C, as indicated by the cut T in FIG. 1, and trim a strip of the carpet C relative to an edge E thereof.

Handle assembly 20 is mounted on leg portion 14 for two types of movement, namely a pivotal movement and an adjustable movement, and handle assembly 20 includes a handle 24 shaped as shown so as to have a base of much greater extent than a hand (not shown) receiving portion thereof, and extending away from the surface of leg portion 14, together with a mounting arrangement including a through hole 26 provided in handle 24 adjacent one longitudinal end of the base portion thereof so as to slidably receive a longitudinally extending element 28, which can be the illustrated rod, disposed extending longitudinally substantially perpendicularly to the extent of web 16, and to the extent of handle 24 itself. Suitable bearing blocks 30 and 30' are affixed to the upper surface of leg portion 14 in order to journal element 28 at the ends thereof on said blocks on said leg portion 14 in such a manner as to permit element 28 to a pivot in a plane substantially parallel to the extent of web 16 and substantially perpendicular to blocks 30 and 30' and allow handle 24 to swing relative to the plane of leg portion 14. As can be seen from the broken lines to make FIG. 4, handle 24 can pivot away from leg portions 24 so as to permit the cutter assembly 22 in a series of partial cuts in order to start a full cut in thick carpet and the like.

The mounting arrangement further includes a bore 32 having internal screw threads and provided in handle 24 so as to communicate with hole 26, with a set screw 34 being threadedly engaged in bore 32 for releasably engaging with element 28 and retaining handle 24 in a desired position relative to the longitudinal extent of the element 28. By this arrangement, handle 28 can perform adjustable movement, inasmuch as it can be positioned along the longitudinal extent of element 28 substantially perpendicular to the extent of web 16 in such a manner as to vary the width of a strip to be cut from carpet C as desired.

The cutter assembly 22 includes in combination with a blade 36 of conventional construction, and similar to the blades employed with conventional utility knives, and the like, and provided with a longitudinally extending cutout 38 arranged for receiving a clamping screw, a holder assembly 40 adjustably mounted on handle 24 and arranged extending through opening 18 provided in leg portion 14.

Holder assembly 40 comprises a blade cover 42 provided with an elongated slot 44 and a planar base 46 thereof, and with a pair of oppositely directed, coplanar flanges 48 and 48' arranged extending along respective sides of slot 44 and extending toward one another for forming a pair of slide guides. Blade 36 is adjustably, slidably received in the slide guides formed by flanges 48 and 48', with cover 42 terminating at one longitudinal end in a pressure foot 50 and at the other longitudinal end with a flange which forms a thumb lift 52 arranged for facilitating adjustment of the blade cover 42 relative to handle 24. Blade 36 is adjustably retained on blade cover 42, and the cover 42 is itself mounted on handle 24, by a clamp 54 which includes a washer 56 formed from a rectangular piece of metal provided with an opening off center thereof, and by a suitable lug 58 having a projection 60 which extends through slot 38 and cutout 44 to cooperate with flanges 48 and 48' in order to prevent blade 36 from changing a preset angle relation to blade cover 42. A conventional bolt 62 can be arranged in a hole provided in lug 58, the hole provided in washer 56, and through cutout 38 and slot 44 to engage in a hole 64 having internal screw threads and provided in a side surface of handle 24 in a portion adjacent the base thereof and spaced longitudinally from the hole 26. In this manner, blade cover 42 can itself be adjusted relative to leg portion 14 so as to place pressure foot 50 firmly on the upper surface of carpet C, and blade 36 can be adjusted relative to cover 42 for varying thicknesses of carpeting, or other material being cut, and the arrangement secured firmly in place by clamp 54.

Figure 4:
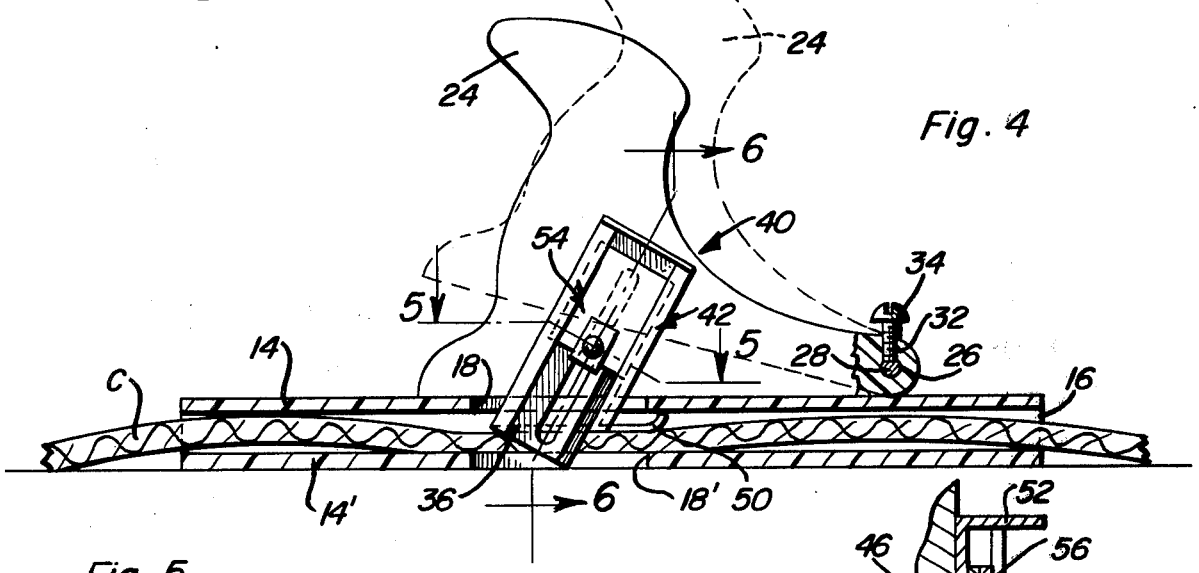
FIG. 4 is a fragmentary, sectional view taken generally along the line 4—4 of FIG. 3.
Figure 5:
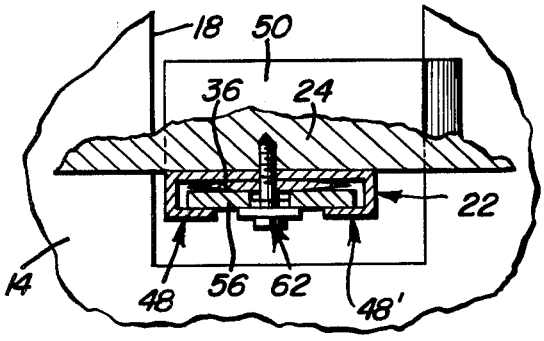
FIG. 5 is an enlarged, fragmentary, sectional view taken generally along the line 5—5 of FIG. 4.
Figure 6:
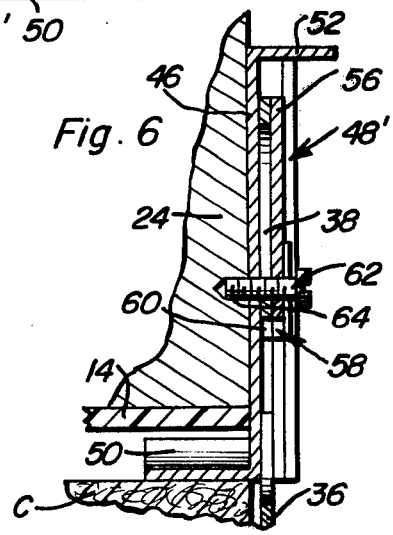
FIG. 6 is an enlarged, fragmentary, sectional view taken generally along the line 6—6 of FIG. 4.

The opening 18' is advantageously provided in leg 14' so as to permit the lowermost portion of the blade 36 to pass entirely thrugh the thickness of carpeting C, as can be seen in FIG. 4.

In operation, handle 24 is locked with the locking set screw 34 so as to determine the width of the cut to be made in a piece of material which has been inserted into the slot formed between leg portions 14 and 14' so as to have an edge E thereof abutting web 16. See FIG. 1. Handle 24 can now be gripped and drawn to the operator (not shown) in the direction of the arrow in FIG. 1 so as to make a cut T in the carpet C. Handle 24 is mounted on the element 28 so as to be raiseable upwardly as seen in FIG. 4 in order to allow handle 24 to make a series of partial cuts in carpet C to start a full cut in some thick carpets. The tool 10 can function in this manner and still maintain the desired width adjustment desired.

As can be readily understood from the above description and from the drawings, a cutting tool, according to the present invention, permits a strip of material to be trimmed from a piece of carpeting in a simple and efficient manner, with the width of the strip being readily adjustable to accommodate different baseboards heights, and the like.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A carpet cutting tool, comprising, in combination:

(A) a body member having a pair of spaced, opposed leg portions and a web connecting together the leg portions along corresponding edges thereof, the leg portions defining therebetween a sheet receiving slot, with one of the leg portions being provided with an opening therein;

(B) handle means mounted on the body member for adjustable movement and pivotal movement, the adjustable movement being substantially perpendicular to the extent of the web of the body member and the pivotal movement being in a plane which is parallel to the extent of the web, the handle means including a handle and mounting means for adjustably attaching the handle to the one of the leg portions of the body member, the mounting means comprising, in combination:

(1) a through hole provided in the handle;

(2) a longitudinally extending element slidably received in the hole provided in the handle and disposed extending longitudinally perpendicularly to the web of the body member; and (3) bearing block means for rotatably supporting the element on the one of the leg portions of the body member and permitting the handle to swing relative to the one of the leg portions, wherein the mounting means further includes a threaded bore provided in the handle and arranged communicating with the hole provided in the handle and a set screw threadedly engaged in the bore and releasably engaged with the element for retaining the handle in a desired position with respect to the web; and (C) cutter means mounted on the handle means for being received in the opening provided in the one of the leg portions and engageable with a sheet disposed within the slot defined between the leg portions for trimming a strip from an edge of the sheet.

2. A structure as defined in claim 1, wherein the cutter means includes, in combination:

(1) a blade;

(2) a blade cover provided with an elongated slot and a pair of oppositely directed, coplanar flanges extending along respective sides of the slot and toward one another for forming a pair of cooperating slide guides, said blade being adjustably received in the slide guides formed by the flanges; and (3) clamp means for engaging the blade cover and retaining the blade in the cover and the cover on the handle means.

3. A structure as defined in claim 2, wherein the leg portions of the body member both are substantially planar and coextensive with one another.

4. A carpet cutting tool, comprising, in combination:

(A) a body member having a pair of spaced, opposed leg portions and a web connecting together the leg portions along corresponding edges thereof, the leg portions defining therebetween a sheet receiving slot, with one of the leg portions being provided with an opening therein;

(B) handle means mounted on the body member for adjustable movement and pivotal movement, the adjustable movement being substantially perpendicular to the extent of the web between the leg portions of the body member and the pivotal movement being in a plane which is substantially parallel to the extent of the web; and (C) cutter means mounted on the handle means for being received in the opening provided in the one of the leg portions and engageable with a sheet disposed within the slot defined between the leg portions for trimming a strip from an edge of the sheet, the cutter means including holder means mounted on the handle means and arranged extending through the opening provided in the one of the leg portions for cuttingly engaging a sheet of material disposed in the slot defined by the leg portions, the holder means comprising, in combination:

(1) a blade cover provided with an elongated slot and a pair of oppositely directed, coplanar flanges extending along respective sides of the slot and toward one another for forming a pair of cooperating slide guides, a cutting blade being adjustably received in the slide guides formed by the flanges; and (2) clamp means for engaging the blade cover and retaining a blade in the cover and the cover on the handle means.

5. A structure as defined in claim 4, wherein the leg portions of the body member both are substantially planar and coextensive with one another.

* * * * *